United States Patent [19]

Hilbrink

[11] Patent Number: 4,641,135

[45] Date of Patent: Feb. 3, 1987

[54] FIELD EFFECT DISPLAY SYSTEM WITH DIODE SELECTION OF PICTURE ELEMENTS

[75] Inventor: Johan O. Hilbrink, Cincinnati, Ohio

[73] Assignee: NCR Corporation, Dayton, Ohio

[21] Appl. No.: 565,996

[22] Filed: Dec. 27, 1983

[51] Int. Cl.[4] ..... G09G 3/36

[52] U.S. Cl. ..... 340/784; 340/718; 340/804

[58] Field of Search ..... 340/718, 719, 784, 805, 340/756, 785, 786, 804; 350/332, 333

[56] References Cited

U.S. PATENT DOCUMENTS

| | | | |
|---|---|---|---|
| 3,532,813 | 10/1970 | Lechner | 350/332 |
| 4,065,764 | 12/1977 | Houryu | 340/804 X |
| 4,110,663 | 8/1978 | Miyazaki et al. | 340/805 X |
| 4,237,456 | 12/1980 | Kanatami | 340/719 |
| 4,251,136 | 2/1981 | Miner et al. | 340/719 X |
| 4,297,695 | 10/1981 | Marshall | 340/752 |
| 4,485,379 | 11/1984 | Kinoshuta et al. | 340/805 X |

*Primary Examiner*—Marshall M. Curtis
*Assistant Examiner*—Vincent P. Kovalick
*Attorney, Agent, or Firm*—Albert L. Sessler, Jr.

[57] ABSTRACT

A liquid crystal display system is comprised of a control system and a display circuit. The control system selectively generates first address signals and first mode control signals during a first mode of operation and second address signals and second mode control signals during a second mode of operation. The display circuit includes a matrix of display means and diode decoding means. Each of the display means comprises a field effect liquid crystal cell having first and second inputs and a diode switching array selectively coupled to the first and second inputs, with the diode decoding means selectively coupled to each diode switching array. During the first mode of operation, the first address signals and first mode control signals are selectively applied to the diode decoding means to selectively cause preselected cells to charge in a first direction through the associated diode switching arrays. During the second mode of operation, the second address signals and second mode control signals are selectively applied to the diode decoding means to selectively cause the preselected cells to charge in a second direction through their associated diode switching arrays.

17 Claims, 15 Drawing Figures

A-VOLTAGE TRANSLATOR

B-VOLTAGE TRANSLATOR

FIG. 6D
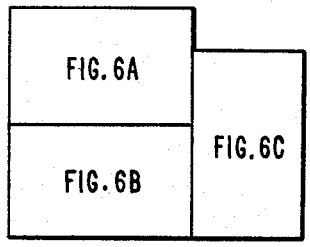
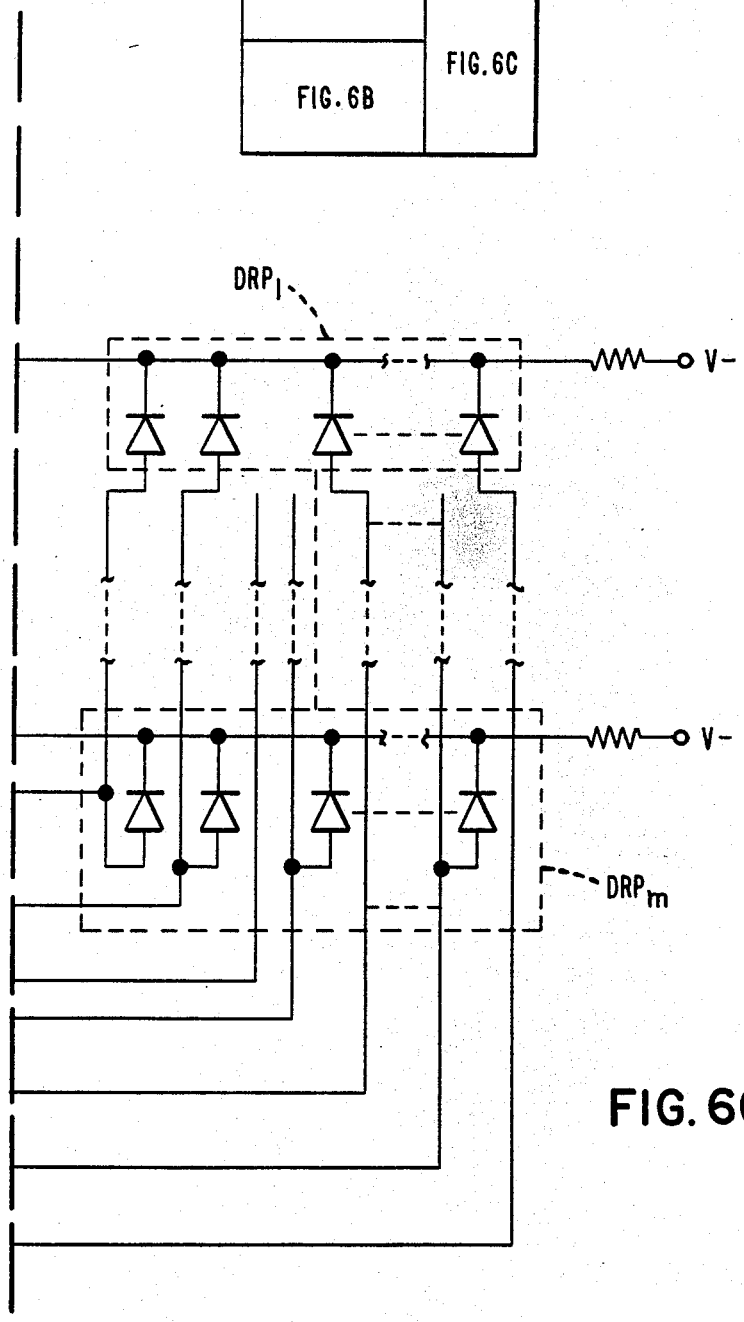
FIG. 6C

INITIAL CONDITION
ALL DIODES BACKBIASED

CAPACITOR MEMORY CHARGES
IN DIRECTION OF P FIELD

ALL DIODES BACKBIASED TO RETAIN
P-FIELD CHARGE IN CAPACITOR MEMORY

CAPACITOR MEMORY CHARGES
IN DIRECTION OF N FIELD

ALL DIODES BIASED TO RETAIN
N-FIELD CHARGE IN CAPACITOR MEMORY

FIELD EFFECT DISPLAY SYSTEM WITH DIODE SELECTION OF PICTURE ELEMENTS

BACKGROUND OF THE INVENTION

1. Field of the Invention

The present invention relates to a display apparatus and more particularly to an addressable matrix of field effect picture elements utilizing the selective diode switching of voltages for picture element turn-on and charge-retention in each of two modes of operation.

2. Description of the Prior Art

In the prior art, many types of display circuits utilizing diodes have been proposed.

U.S. Pat. No. 3,532,813 discloses a display circuit which includes a matrix of display means. Each display means includes a dynamic scattering nematic liquid crystal cell and a capacitor connected in shunt with the cell through the relatively low impedance of a fast reset pulse generator for the row containing the cell. The addressing means for each display means includes a first diode to charge the cell in the associated display means and a second diode to erase the cell in that display means. A row pulse generator is connected to each row of the matrix and a column pulse generator is connected to each column of the matrix. In addition, a reset pulse generator is connected to each row of the matrix. Selection of a liquid crystal cell to light up is accomplished by the coincidence of the row and column pulses for that cell. This enables current to flow through the first diode to cause both dynamic scattering to occur in the liquid crystal cell and the shunt capacitor to become charged. After the coincident row and column pulses for the cell have terminated, the shunt capacitor discharges into the liquid crystal cell, maintaining it in its dynamic scattering condition. Immediately prior to the time that it is desired again to write information into a liquid crystal cell, the reset pulse generator for the row containing that cell is turned on. When turned on, the reset pulse generator applies a negative pulse to each of the second diodes in that row to cause the shunt capacitors and internal capacitances of the cells in that row to discharge through those diodes. After the negative pulse produced by the reset pulse generator terminates, but before the next row and column pulses, the fast reset pulse generator for the row containing the cell applies a pulse across the shunt capacitors and cells in that row to turn off the cells in that row.

U.S Pat. No. 4,065,764 discloses a liquid crystal display device which comprises mutually insulated numeric segment electrodes for forming numeric characters, mutually insulated digit segment electrodes opposed to the numeric segment electrodes, liquid crystal interposed between the numeric segment electrodes and the digit segment electrodes, switching elements such as diodes selectively coupled to the digit segment electrodes and a driving circuit operable in accordance with digit signals and numeric signals to drive the segments in the liquid crystal display device in a time division multiplex manner. The diodes connected to the digit segment electrodes operate to prevent undesired cross-talk between the segments as the liquid crystal display device is driven.

U.S. Pat. No. 4,297,695 discloses an electrochromic display device comprised of a matrix of column lines and row lines. The matrix is divided into submatrices, each submatrix being defined by a pair of column lines which intersect with a pair of row lines to form four points at the four intersections in the submatrix. Each individual point in the matrix is addressable to produce a local color change in the electrochromic material of the device by sequentially applying expose and develop pulses to that point. To build up an image of graphic information in the display device, short expose pulses are applied via diodes to associated pairs of column and row lines to only those submatrices in which a particular point is to be addressed, and then longer develop pulses are applied via diodes to individual columns and individual rows to the point in each of the exposed submatrices. This procedure is repeated for each of the remaining points in the selected submatrices, thereby covering all of the other desired corresponding points in the submatrices to complete the image. For a matrix comprised of a set of 5 by 7 submatrices, this procedure would be performed 35 times.

SUMMARY OF THE INVENTION

According to the present invention, there is provided a display system comprising:

a matrix of display means, each of said display means including a field effect picture element having first and second inputs and a diode array selectively coupled to said first and second inputs;

means for selectively generating first and second address signals and a plurality of mode control signals during first and second modes of operation; and diode decoding means selectively coupled to said matrix of display means and being responsive to said first and second address signals and to said plurality of mode control signals from said generating means for selectively enabling predetermined ones of said diode arrays to turn on associated ones of said picture elements in a first direction during said first mode of operation and in a second direction during said second mode of operation.

It is, therefore, an object of this invention to provide a system and method for the selective diode switching of voltages to selected capacitive memories in a twisted nematic liquid crystal display.

Another object of this invention is to provide a system and method for selectively displaying alphanumeric characters on a display comprising a matrix of field effect picture elements.

Another object of this invention is to provide a system and method for selectively displaying alphanumeric characters on a twisted nematic liquid crystal display by using an associated set of diodes as a picture element selection means when a picture element is being addressed and by using that set of diodes to retain the charge in the internal capacitance of that picture element when that picture element is not being addressed.

A further object of this invention is to provide a system, and a method therefor, for a field effect liquid crystal display which utilizes an associated array of diodes with each picture element in the array to selectively write and retain an electrical charge in either of two directions across selected picture elements.

BRIEF DESCRIPTION OF THE DRAWINGS

These and other objects, features and advantages of the invention, as well as the invention itself, will become more apparent to those skilled in the art in the light of the following detailed description taken in consideration with the accompanying drawings wherein:

FIGS. 6A, 6B and 6C are combined, as shown in FIG. 6D, to form a composite schematic diagram of the display circuit of FIG. 1;

DESCRIPTION OF THE PREFERRED EMBODIMENT

It should be noted at this time that, throughout this description of the preferred embodiment, the presence of a slash (/) following either a symbol or an acronym represents the logical inversion of that symbol or acronym.

Figure 1:
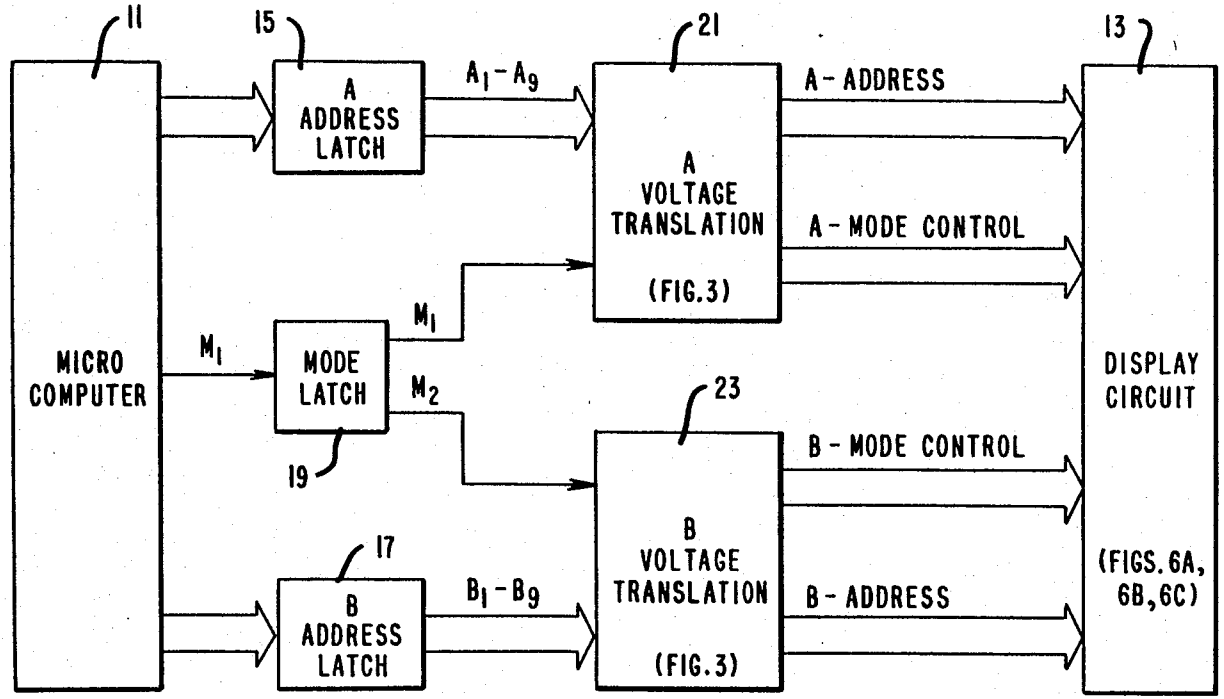
FIG. 1 is a schematic block diagram of a preferred embodiment of the invention.

Referring now to the drawings, FIG. 1 discloses a schematic block diagram of a preferred embodiment of the invention. Basically, the invention is a display system which utilizes a microprocessor or microcomputer 11 to supply signals via intermediate circuitry to drive a field effect material in a display circuit 13 to provide a matrix display of picture elements or pixels in first (P) and second (N) modes of operation. In the context of the present invention a field effect material is a material that changes its reflective characteristics under the influence of an electrical field.

Although the display circuit 13 will be described in this specification as displaying alphanumeric characters, it should be understood that the invention could be utilized to provide a flat television screen or any other desired readout. For purposes of this description, the microcomputer 11 can be an Intel 8051 microcomputer and the field effect material in the display circuit 13 can be a twisted nematic liquid crystal material.

Microcomputer 11 is programmed to sequentially develop the desired addresses of the display picture elements or pixels to be turned on in sequence, as well as the mode of operation signal $M_1$, to form the desired display on the display circuit 13. The system selects only one picture element at a time to be turned on. As a result, the address of a given picture element to be turned on in the display circuit 13 is selectively latched into A address latch 15 and B address latch 17. The mode of operation signal $M_1$, which is a binary "1" or "0" signal, is latched into mode latch 19 to enable mode latch 19 to output $M_1$ and its complement $M_2$.

Address latches 15 and 17 may be implemented by means of Texas Instruments latches having part number SN74ALS273, while mode latch 19 may be implemented by means of a Texas Instruments latch having part number SN74ALS109.

For purposes of this description it will now be assumed that the display circuit 13 is comprised of an M by N matrix of picture elements or pixels to display 80 characters in each of 50 text lines. In this case, M and N can be 454 and 481, respectively. In this event, any given structure element or pixel in that M by N matrix can be addressed by a 9-bit column address and a 9-bit row address. Consequently, an exemplary 9-bit column/row address $A_1$–$A_9$ is latched into A-address latch 15 and an exemplary 9-bit row/column address $B_1$–$B_9$ is latched into B-address latch 17.

Address $A_1$–$A_9$ from A-address latch 15 and $M_1$ from mode latch 19 are applied to A-voltage translation circuit 21. Similarly, address $B_1$–$B_9$ from B-address latch 17 and $M_2$ from mode latch 19 are applied to B-voltage translation circuit 23. The voltage translation circuits 21 and 23 function to translate the input $A_1$–$A_9$, $M_1$, $B_1$–$B_9$ and $M_2$ signals from integrated logic circuit voltages (0 volts or +5 volts) to the voltages required to operate the display circuit 13. The voltage translated A-address and A-mode control outputs of translation circuit 21 and B-address and B-mode-control outputs of translation circuit 23 are then applied to the display circuit 13.

The alphanumeric display in the display circuit 13 comprises a number of display text lines and a number of character positions on each line. Each character position allows a character to be displayed by selectively turning on pixels arranged in, for example, a 5 by 7 dot submatrix. Each pixel in the display circuit 13 can be addressed by means of the A-address and B-address lines in either a P or an N mode of operation (to be explained).

In the operation of the system of FIG. 1, the microcomputer 11 stores two types of display information. It stores the ASCII codes for the alphanumeric characters to be displayed, and it stores in an internal character ROM (not shown) the pattern of pixels or picture elements for each of those characters. For example, the ASCII code for the letter A is 301 (11000001), while the pattern of pixels that make up the display of the letter A in the display circuit 13 is shown in the exemplary 5 by 7 dot submatrix 25 of FIG. 2.

Figure 2:
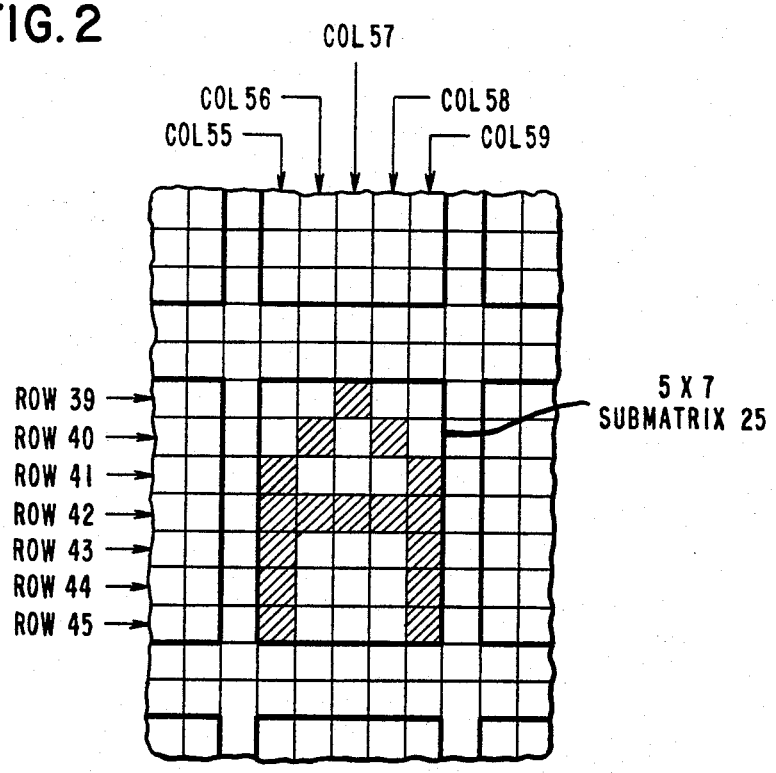
FIG. 2 is a graphical representation of a 5 by 7 pixel submatrix which can be used in the display circuit of FIG. 1.

For purposes of illustration, FIG. 2 shows adjacent character positions enclosed in dark lines, with a one-pixel spacing between adjacent horizontal character positions and a two-pixel spacing between adjacent vertical character positions.

Assume that, in the execution of a program to display alphanumeric characters on the display circuit 13, the microcomputer 11 is to display the character A in the 10th character position of display text line 5, shown as submatrix 25 in FIG. 2. Essentially, to write the character A into the 5 by 7 dot submatrix 25, each of the cross-hatched pixels in the submatrix 25 of FIG. 2 is turned on (made "black") in the pattern of the character A. To accomplish this, the microcomputer 11 compites the addresses for the pixels that make up the character A for the 10th character position on display text line 5 and then it generates the sequence of the addresses for the pixels that need to be turned on.

Initially the microcomputer 11 locates the address of the beginning pixel in the upper left-hand corner of the 10th character position on display text line 5. This beginning pixel is located at address 55, 39 which is the 55th pixel horizontally from the left and the 39th pixel down from the top of the display in the display circuit 13. The microcomputer 11 then determines from the pattern for the character A in its internal character ROM that the third pixel in the first line of the character A needs to be turned on. So the microcomputer 11 generates the associated address 57, 39 (column 57, row 39) for that third pixel and selectively strobes that address 57, 39 into the A and B address latches 15 and 17. These address signals, along with the mode signals $M_1$ and $M_2$ cause the voltage translation circuits 21 and 23 to provide the proper voltages to the display circuit 13 to turn on the pixel located at address 57, 39 (column 57, row 39). After turning on the pixel at address 57, 39, the microcomputer 11 determines that there are no more pixels on the top line of the character A in the character ROM that need to be displayed. In the same manner, the microcomputer 11 then sequentially develops addresses 56, 40 and 58, 40 for the second line in the character A in the character ROM; 55, 41 and 59, 41 for the third line in the character A in the character ROM; and so on until addresses have been generated for the remaining picture elements to be turned on in the display circuit 13 for the character A in the submatrix 25. After all of the cross-hatched pixels in submatrix 25 of FIG. 2 have been selectively turned on, the character A is displayed.

It should be noted that the A and B address latches 15 and 17 do not always respectively contain the column and row addresses. The A address latch 15 contains the column address and the B address latch 17 contains the row address in one of the P and N modes, but in the other one of the P and N modes the A address latch 15 contains the row address and the B address latch 17 contains the column address.

Figure 3:
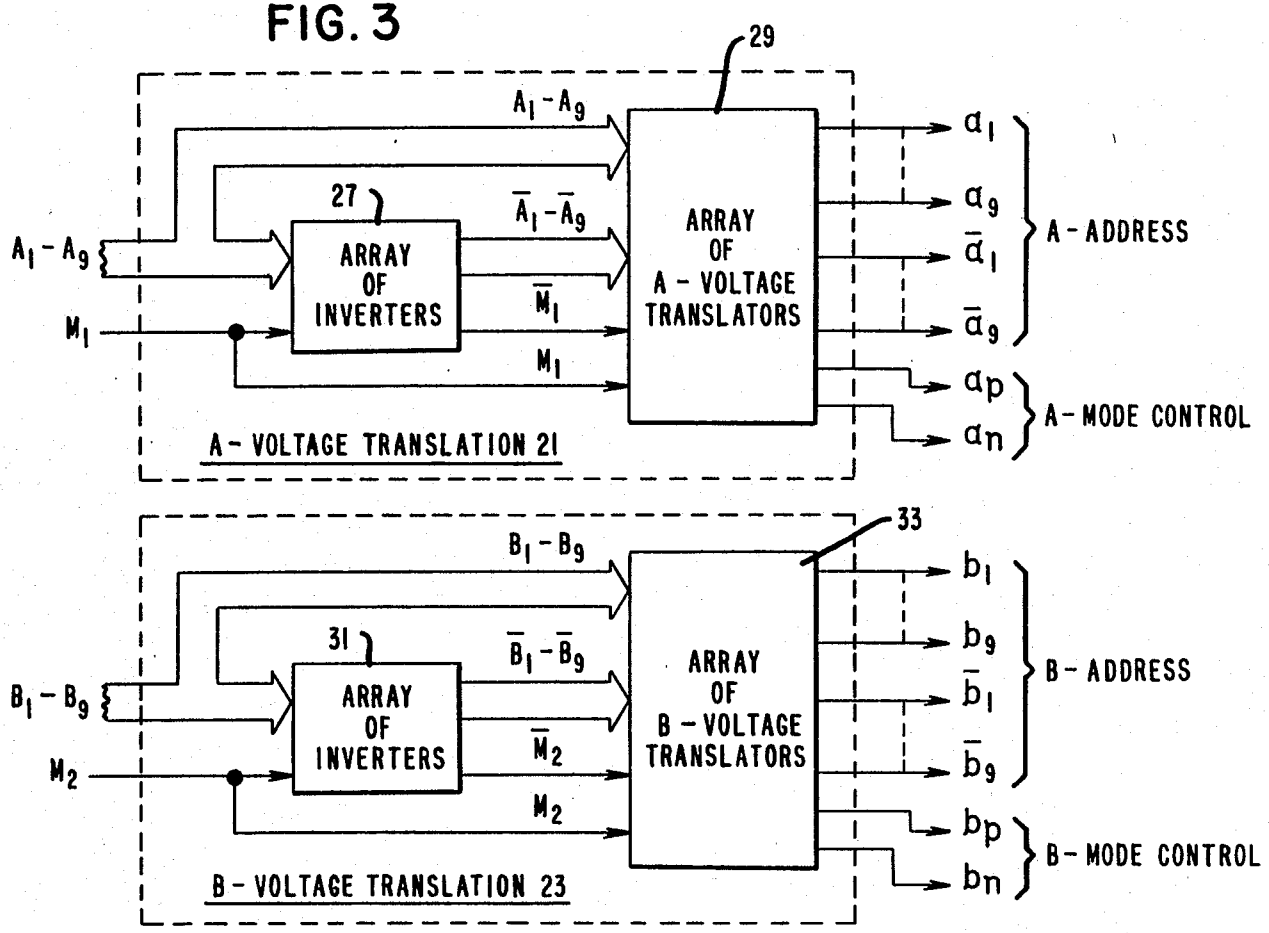
FIG. 3 is a schematic block diagram of the A and B voltage translation circuits of FIG. 1.

Referring now to FIG. 3, the A− and B− voltage translation circuits 21 and 23 are shown in greater detail.

In the A− voltage translation circuit 21, the $M_1$ bit and the $A_1$–$A_9$ address bits are logically inverted by an array of inverters 27 to develop complementary $M_1$/ and $A_1$/–$A_9$/ bits. The $M_1$ and $A_1$–$A_9$ bits and their complements $M_1$/ and $A_1$/–$A_9$/ are then applied to an array of A− voltage translators 29, which array 29 develops voltage translated A address signals $a_1 \ldots a_9$ and $a_1$ / . . . $a_9$/ and A-mode control signals $a_p$ and $a_n$ suitable to operate the display circuit 13.

Similarly, in the B-voltage translation circuit 23, the $M_2$ bit and $B_1$–$B_9$ address bits are logically inverted by an array of inverters 31 to develop complementary $M_2$/ and $B_1$/–$B_9$/ bits. The $M_2$ and $B_1$–$B_9$ bits and their complements $M_2$/ and $B_1$/–$B_9$/ are then applied to an array of B-voltage translators 33, which array 33 develops voltage translated B-address signals $b_1 \ldots b_9$ and $b_1$/ . . . $b_9$/ and B-mode control signals $b_p$ and $b_n$ suitable to operate the display circuit 13.

Each of the arrays of inverters 27 and 31 contains ten inverters (not shown), one inverter for each input bit. Similarly, each of the arrays of voltage translators 29 and 33 contains 20 voltage translators, one voltage translator for each input bit. An A-voltage translator is shown in FIG. 4, while a B-voltage translator is shown in FIG. 5.

Figure 4:
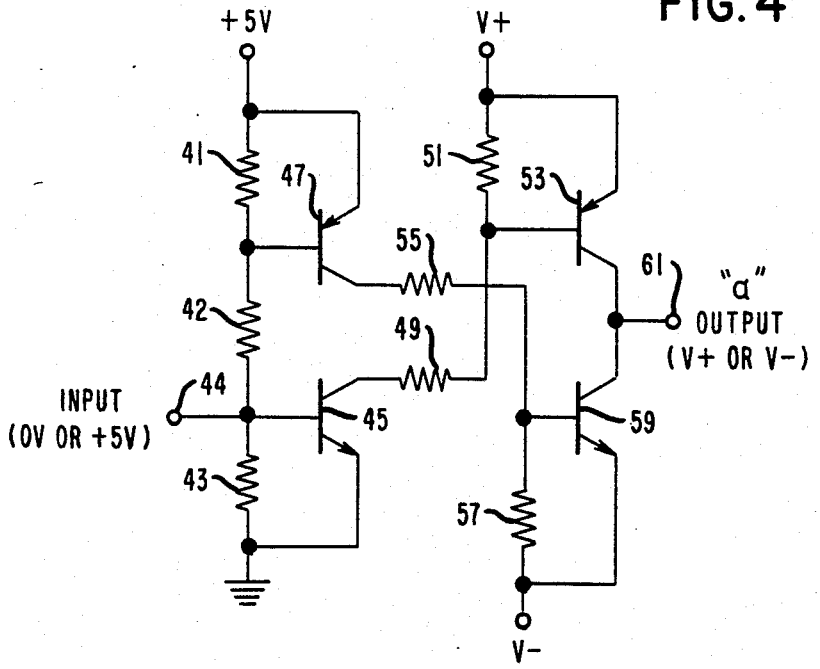
FIG. 4 is a schematic circuit diagram of one of the array of A-voltage translators of FIG. 3.
Figure 5:
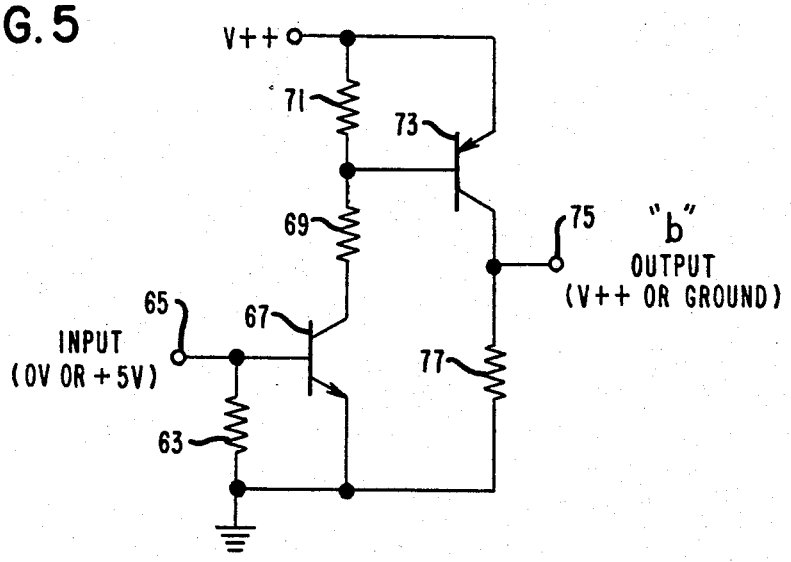
FIG. 5 is a schematic circuit diagram of one of the array of B-voltage translators of FIG. 3.

The A-voltage translator illustrated in FIG. 4 translates an integrated logic circuit low input voltage of 0 V (zero volts) to an output drive logic voltage of V−, and also translates an integrated logic circuit high input voltage of +5 V to an output drive logic voltage of V+. Exemplary values for V− and V+ are −5 V and +5 V, respectively, providing a logic swing of 10 V therebetween.

As shown in FIG. 4, serially connected resistors 41, 42 and 43 are coupled between +5 V and ground. An input terminal 44 is connected to the junction of resistors 42 and 43 and to the base of an NPN transistor 45 which has its emitter grounded. The junction of resistors 41 and 42 is connected to the base of a PNP transistor 47 which has its emitter returned to +5 V. The collector of transistor 45 is connected through resistors 49 and 51 to V+. The unction of resistors 49 and 51 is connected to the base of PNP transistor 53 which has its emitter returned to V+. The collector of transistor 47 is connected through resistors 55 and 57 to V−. The junction of resistors 55 and 57 is connected to the base of NPN transistor 59 which has its emitter returned to V−. The collectors of transistors 53 and 59 are connected together at an output terminal 61 to develop an "a" output. This "a" output represents one of the $a_1$ . . . $a_9$, $a_1$/ . . . $a_9$/, $a_p$ and $a_n$ outputs from the array of A-voltage translators 29 (FIG. 3).

When a low input voltage of 0 V is applied to the input terminal 44, no current flows through resistor 43. The resultant 0 V drop across resistor 43 is below the base-emitter turn-on voltage of transistor 45. As a result, transistor 45 is turned off. When transistor 45 is turned off, no current flows through resistors 51 and 49. Consequently, resistor 51 pulls up the base of transistor 53 above the base-emitter turn-on voltage of transistor 53, turning off transistor 53. On the other hand, the input voltage of 0 V causes the base-emitter voltage of transistor 47 to fall below the base-emitter turn-off voltage of transistor 47. This turns on transistor 47, causing current to flow from +5 V through the collector-emitter region of transistor 47 and through resistors 55 and 57 to V−. The resultant voltage drop across resistor 57 is above the base-emitter turn-on voltage of transistor 59. As a result, transistor 59 is turned on, causing an output voltage of V− to be developed at output terminal 61.

When a high input voltage of +5 V is applied to the input terminal 44, no current flows through resistors 41 and 42. So the base-emitter voltage of transistor 47 is 0 V and transistor 47 is turned off. When transistor 47 is turned off, no current flows through resistors 55 and 57. In this case, the baseemitter voltage of transistor 59 is below the turn-on voltage of transistor 59. Hence, transistor 59 is turned off. On the other hand, the input voltage of +5 V forward biases the base-emitter region of transistor 45, causing transistor 45 to turn on. When transistor 45 turns on, current flows from V+ through resistors 51 and 49 and through the collector-emitter region of transistor 45 to ground. The resultant voltage drop across resistor 51 forward biases transistor 53, turning on transistor 53. When transistor 53 is turned on, an output voltage of V+ is developed at output terminal 61.

The B-voltage translator illustrated in FIG. 5 translates an integrated logic circuit low input voltage of 0 V to an output drive logic voltage of 0 V or GROUND, and also translates an integrated logic circuit high input voltage of +5 V to an output drive logic voltage of V++. An exemplary value for V++ can be +10 V, providing a logic swing of 10 V between V++ and GROUND.

As shown in FIG. 5, resistor 63 is connected between input terminal 65 and ground. An NPN transistor 67 has its base and emitter connected to terminal 65 and ground, respectively, and its collector coupled through serially-connected resistors 69 and 71 to V++. The junction of resistors 69 and 71 is connected to the base of PNP transistor 73 which has its emitter returned to V++. The collector of transistor 73 is connected directly to output terminal 75 and also through resistor 77 to ground. A "b" output is developed at output terminal 75. This "b" output represents one of the $b_1 \ldots b_9$, $b_1/-b_9/$, $b_p$ and $b_n$ outputs from the array of B-voltage translators 33 (FIG. 3).

When a low input voltage of 0 V is applied to input terminal 65, no current flows through resistor 63. The resultant 0 V drop across resistor 63 is below the base-emitter turn-on voltage of transistor 67. As a result, transistor 67 is turned off. When transistor 67 is turned off, no current flows through resistors 69 and 71. Consequently, the base-emitter voltage of transistor 73 is 0 V and transistor 73 is turned off. When transistor 73 is turned off, no current flows through resistor 77 and therefore an output voltage of 0 V is developed at output terminal 75.

When a high input voltage of +5 V is applied to input terminal 65, the transistor 67 is forward biased into conduction. Current flows from V++ through resistors 71 and 69 and through the transistor 67 to ground. The resultant voltage drop across resistor 71 forward biases transistor 73, turning transistor 73 on. When transistor 73 is turned on, an output voltage of V++ is developed at output terminal 75.

Figure 6A:
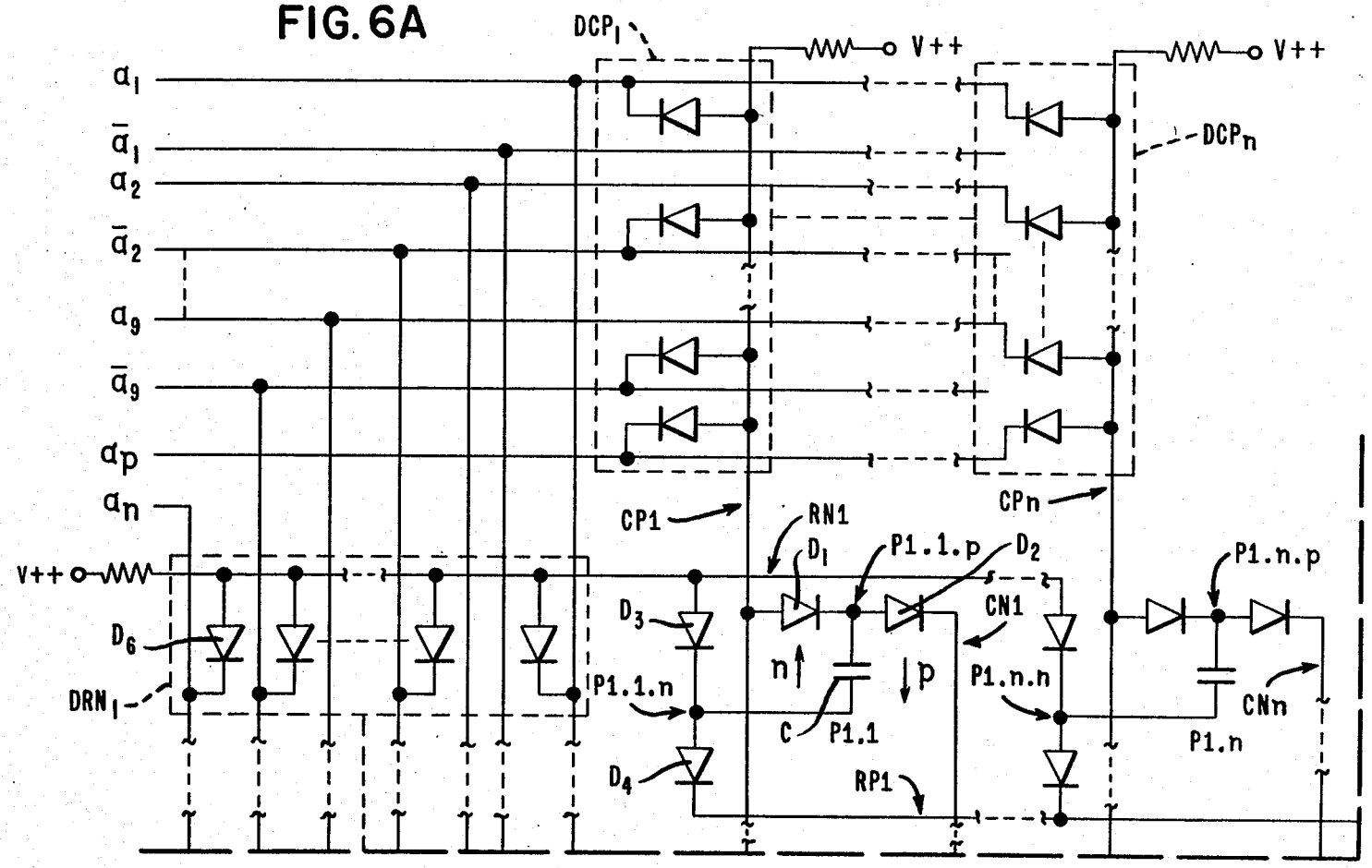

The display circuit 13 of FIG. 1 will now be discussed in detail by referring to FIGS. 6A, 6B and 6C, which figures are combined as shown in FIG. 6D to form a composite schematic circuit diagram of the display circuit 13.

Figure 6B:
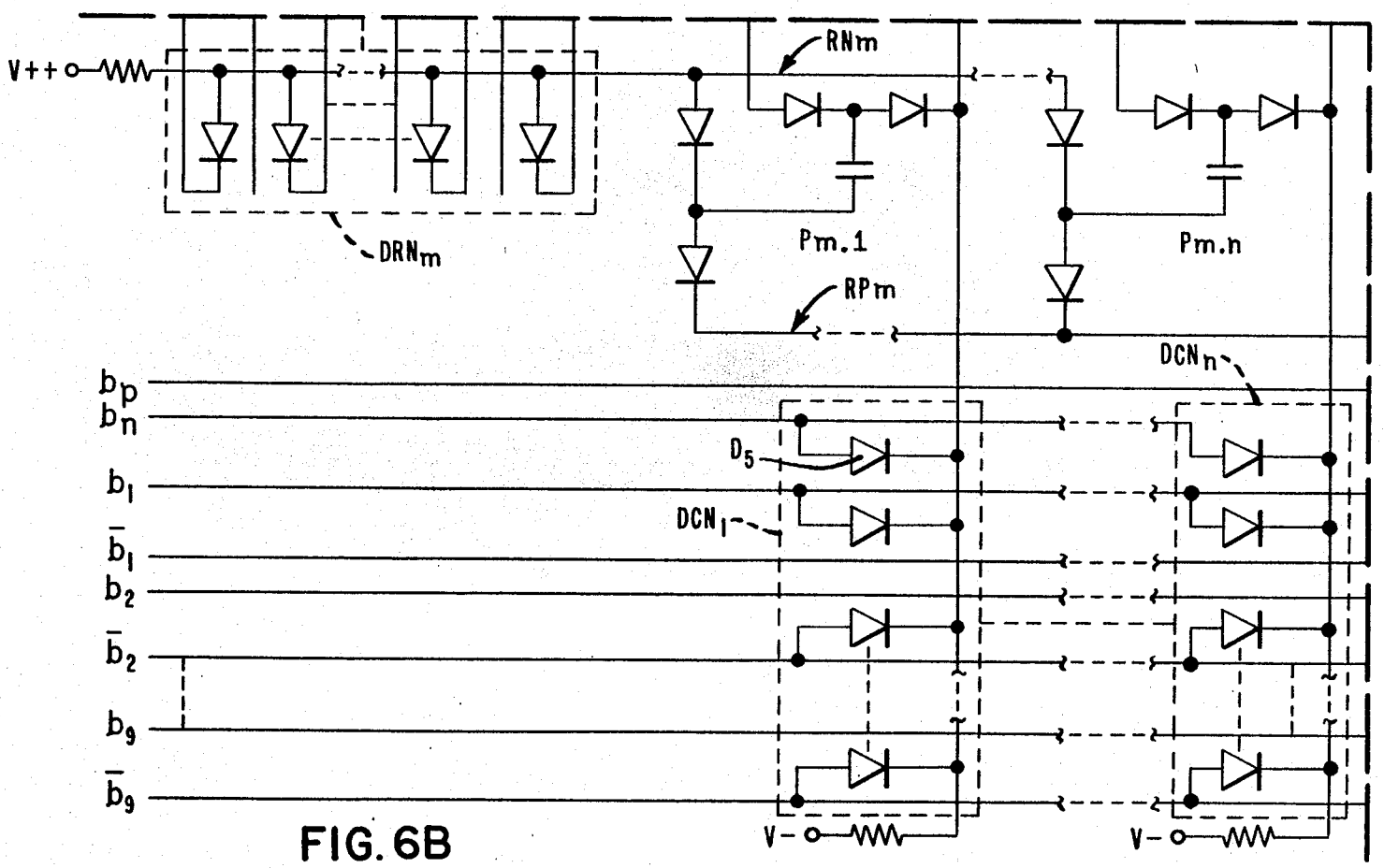
Figure 8A:
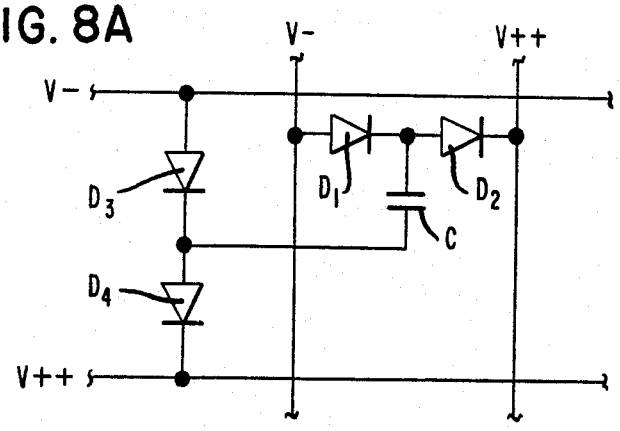
FIGS. 8A through 8E illustrate the voltages selectively applied to the selected picture element P1.1 during an initial condition, during a first mode of operation to enable the picture element to charge in the direction of the p-field and then retain that p-field charge, and during a second mode of operation to enable the picture element to charge in the direction of the n-field and then retain that n-field charge.
Figure 8B:
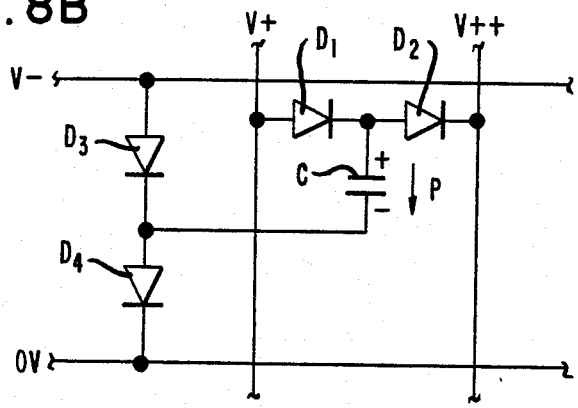
Figure 8C:
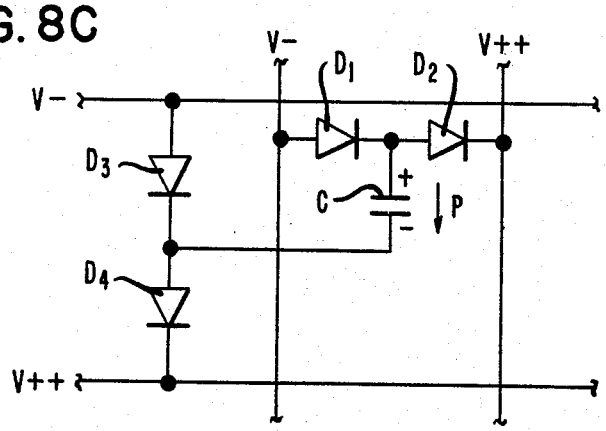
Figure 8D:
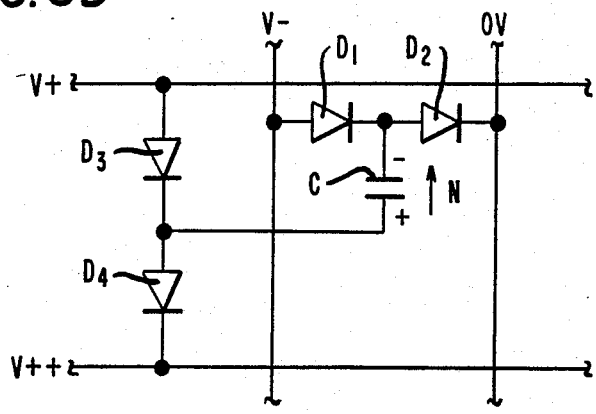
Figure 8E:
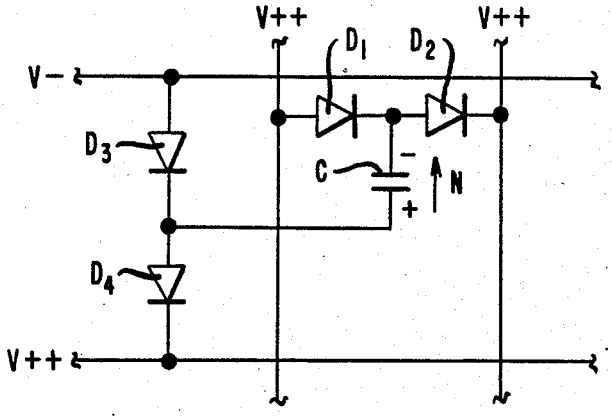

FIGS. 6A, 6B and 6C show a matrix of field effect display picture elements, such as twisted nematic liquid crystal picture elements or pixels. Although the display circuit 13 will be described as utilizing a twisted nematic liquid crystal material in each of the picture elements, it should be reiterated that the use of any other suitable field effect material in the picture elements is within the purview of the invention. As stated before, a field effect material within the context of the present invention is a material that changes its reflective characteristics under the influence of an electrical field.

The matrix of picture elements or pixels is arranged in N columns identified by subscripts 1 . . . n and M rows identified by subscripts 1 . . . m. For example, $P_{1.1}$–$P_{1.n}$ are the picture elements or pixels in row 1 and $P_{1.n}$–$P_{mn}$ are the picture elements or pixels in column n. In this manner, a pixel P is identified by its row and column positions. For example, pixel $P_{2.7}$ is the pixel P located at the intersection of row 2 and column 7.

Electrically each pixel P in the matrix of pixels operates as a capacitor due to the internal capacitance of the pixel, with the twisted nematic liquid crystal display material disposed between the plates of the capacitor. When a voltage is applied to the capacitor, the capacitor charges and the resultant electrical field will act on the liquid crystal material in such a manner that the pixel P will turn on. When the charge, and consequently the electrical field, is removed from the capacitor, the liquid crystal material will cause the pixel to turn off. The internal capacitance for pixel $P_{1.1}$ in FIG. 6A is shown as capacitor C.

In the operation of the system (FIG. 1) only one pixel P is selected by row and column at a time. Only those pixels that require the liquid crystal material to be turned on need to be selected. For an alphanumeric display, the number of pixels needed to represent a character is less than half the number of pixels in a submatrix. FIG. 2 is an illustration of this feature.

It will be recalled that the alphanumeric display in the display circuit 13 comprises a number of display text lines and a number of character positions on each line and that each character position allows a character to be displayed by selectively turning on pixels arranged in a 5 by 7 dot submatrix. Each pixel to be turned on is addressed by means of the A-address and B-address lines from the A− and B− voltage translation circuits 21 and 23, respectively, of FIG. 1. By addressing each pixel sequentially, the number of signal lines from the translation circuits 21 and 23 is minimized. For example, a display circuit 13 for 50 lines of text, each having 80 character positions with each character position employing the 5 by 7 dot submatrix, requires only 40 signal lines from the translation circuits 21 and 23. These exemplary signal lines from the voltage translation circuits 21 and 23 are shown in FIGS. 6A, 6B and 6C as A-address lines $a_1 \ldots a_9$ and $a_1/ \ldots a_9/$, A-mode control lines $a_p$ and $a_n$, B-address lines $b_1 \ldots b_9$ and $b_1/ \ldots b_9/$ and B-mode control lines $b_p$ and $b_n$.

Due to the nature of the twisted nematic liquid crystal material used in each pixel, the electrical field that turns a pixel on needs to be periodically reversed in such a manner that the resultant average field across the capacitance of that pixel is zero. Such a periodic reversal of the electrical field across a pixel prevents the diffusion of the twisted nematic liquid crystal material to one plate of the capacitance of that pixel. Arbitrarily, for purposes of this description, one direction of the electrical field is identified by p while the direction of the reverse electrical field is identified by n. The directions of the p and n electrical fields are shown in pixel $P_{1.1}$ in FIG. 6A.

The display circuit 13 shown in FIGS. 6A, 6B and 6C uses voltages V++ and V− from a power supply (not shown). In addition, the display circuit 13 receives V−, V+, V++ and ground (0 V) voltages from the voltage translation circuits 21 and 23 (FIG. 3) via the A− address lines $a_1 \ldots a_9$ and $a_1/ \ldots a_9/$, A-mode control lines $a_p$ and $a_n$, B-address lines $b_1 \ldots b_9$ and $b_1/ \ldots b_9/$ and B-mode control lines $b_p$ and $b_n$, as a function of the address and mode signals outputted by microcomputer 11, as discussed before.

The absolute values of the V−, V+ and V++ voltages depend on the value of the electrical field required to turn on a specific twisted nematic liquid crystal material and the distance between the equivalent capacitor plates of a pixel. Available twisted nematic liquid crystal materials, in a practical display construction, turn on at approximately 2 to 4 volts. In a display of this nature, the absolute value of either V− or V+ is about 5 volts. The absolute value of V++ should be higher than the absolute value of V− and V+ and sufficient to backbias a diode (to be explained). The absolute value of V++ can be chosen to be 7.5 to 10 volts.

The display circuit 13 of FIGS. 6A, 6B and 6C is selectively operated in P and N modes of operation. In the P mode, the capacitors (C) of the pixels that are required to be turned on are selectively charged to provide electrical fields in the p direction. In the N mode, those capacitors are selectively charged to provide electrical fields in the n direction.

In the P mode of operation of the display circuit 13, a pixel in a given column and given row is selected by selectively addressing that given column with the A-address lines $a_1 \ldots a_9$ and $a_1/\ldots a_9/$ and that given row with the B-address lines $b_1 \ldots b_9$ and $b_1/\ldots b_9/$. In the N mode of operation of the display circuit 13, that pixel is selected by selectively addressing that given column with the B-address lines $b_1 \ldots b_9$ and $b_1/\ldots b_9/$ and that given row with the A-address lines $a_1 \ldots a_9$ and $a_1/\ldots a_9/$. The mode of operation of the display circuit 13 is determined by the state of the mode of operation signal $M_1$ (FIG. 3). In the P mode of operation, the mode control lines $a_p$ and $b_p$ (FIGS. 3, 6A–6C) are active. In the N mode of operation, the mode control lines an and bn (FIGS. 3, 6A–6C) are active.

In the P mode of operation, the column address is decoded by diode gate decoder assemblies or diode decoders $DCP_1$–$DCP_n$ selectively connected to the A-address lines $a_1 \ldots a_9$ and $a_1/\ldots a_9/$, while the row address is decoded by diode gate decoder assemblies or diode decoders $DRP_1$–$DRP_m$ selectively connected to the B-address lines $b_1 \ldots b_9$ and $b_1/\ldots b_9/$. Similarly, in the N mode of operation, the column address is decoded by diode gate decoder assemblies or diode decoders $DCN_1$–$DCN_n$ selectively connected to the B-address lines $b_1 \ldots b_9$ and $b_1/\ldots b_9/$, while the row address is decoded by diode gate decoder assemblies or diode decoders $DRN_1$–$DRN_m$ selectively connected to the A-address lines $a_1 \ldots a_9$ and $a_1/\ldots a_9/$. For example, in the P mode of operation, the diodes in decoder assembly $DCP_1$ for column 1 decode the address lines $a_1$, $a_2/\ldots a_9/$ which represent 000000001 in binary notation, while the diodes in decoder assembly $DRP_1$ for row 1 decode the address lines $b_1$, $b_2/\ldots b_9/$ which represent 000000001 in binary notation.

The A-address lines $a_1 \ldots a_9$ and $a_1/\ldots a_9/$ can exist in either of two states, TRUE or FALSE, where the voltage for logic TRUE is V+ and the voltage for logic FALSE is V−. Similarly, the B-address lines can exist in either a TRUE state or a FALSE state, where the voltage for logic TRUE is represented by GROUND (0 V) and the voltage for logic FALSE is V++.

The mode control lines $a_p$ and $a_n$ are complementary signals. They are not TRUE at the same time. However, they will both be FALSE at the same time, during the period of time that the A and B addresses from microcomputer 11 (FIG. 1) are strobed into A and B address latches 15 and 17 (FIG. 1), respectively. TRUE and FALSE for the mode control signals $a_p$ and $a_n$ are V+ and V−, respectively.

The mode control lines $b_p$ and $b_n$ are not TRUE at the same time. However, they will both be FALSE at the same time, during the period of time that the A and B addresses from microcomputer 11 (FIG. 1) are strobed into A and B address latches 15 and 17 (FIG. 1), respectively. TRUE and FALSE for the mode control signals $b_p$ and $b_n$ are GROUND and V++, respectively.

In order to write a p field into a pixel position, a column is selected on the A-address lines and a row is selected on the B-address lines. For purposes of illustration the operation of the display circuit 13 of FIGS. 6A, 6B and 6C will be explained by writing a p field into pixel $P_{1.1}$. In order to address column 1 the A-address lines $a_1$, $a_2/\ldots a_9/$ are selected TRUE (V+). To address row 1 the B-address lines $b_1$, $b_2/\ldots b_9/$ are selected TRUE (GROUND).

When the mode control line $b_p$ is also selected TRUE (GROUND), all the diodes in diode gate decoder $DRP_1$ are forward biased, causing the voltage on row line $RP_1$ to go to a voltage one diode drop below GROUND. This causes diode $D_4$, which is connected between node $P_{1.1.n}$ and row line $RP_1$, to become forward biased. Due to the voltage drop of the forward biased diode $D_4$, the voltage on node $P_{1.1.n}$ will be GROUND.

Since, as stated before, $b_p$ and $b_n$ are not TRUE at the same time, $b_n$ is FALSE (V++) at this time. This V++ value of $b_n$ forward biases diode $D_5$ in diode gate decoder $DCN_1$, causing column line $CN_1$ to go to approximately V++, thereby backbiasing diode $D_2$ (which is connected between node $P_{1.1.p}$ and column line $CN_1$).

When the mode control line $a_p$ is also selected TRUE (V+), all the diodes in diode gate decoder $DCP_1$ are forward biased by V+ on their cathodes and a higher potential on their anodes, causing the voltage on column line $CP_1$ to go to a voltage one diode drop above V+. This causes diode $D_1$, which is connected between node $P_{1.1.p}$ and column line $CP_1$ to become forward biased. Due to the voltage drop of the forward biased diode $D_1$, the voltage on node $P_{1.1.p}$ goes to V+.

Since, as stated before, $a_p$ and $a_n$ are not TRUE at the same time, an is FALSE (V−) at this time. This V− value of $a_n$ forward biases diode $D_6$ in diode gate decoder $DRN_1$, causing row line $RN_1$ to go to approximately V−. The V− potential on row line $RN_1$ backbiases diode $D_3$, which is connected between node $P_{1.1.p}$ and row line $RN_1$.

The capacitor C of pixel $P_{1.1}$ will be charged by the voltage differential between nodes $P_{1.1.p}$ and $P_{1.1.n}$. When the mode control line $b_p$ returns to FALSE (V++), row line $RP_1$ will go to V++, thereby backbiasing diode $D_4$. Similarly, when mode control line $a_p$ returns to FALSE (V−), column line $CP_1$ will go to V−, thereby backbiasing diode $D_1$. At this time all of the diodes $D_1$, $D_2$, $D_3$, and $D_4$ coupled to the capacitor C of pixel $P_{1.1}$ are backbiased and the capacitor C is charged. The charge on the capacitor C will be retained, causing an electrical field in the p direction, as indicated in FIG. 6A.

In the N mode of operation an electrical field in the n direction is provided by charging the capacitor C through the node $P_{1.1.n}$. In the N mode of operation, the row is selected by the A-address lines and the column is selected by the B-address lines.

For further purposes of illustration an n field will now be written into pixel $P_{1.1}$. In order to address column 1 in the N mode of operation, the B-address lines $b_1$, $b_2/\ldots b_9/$ are all selected TRUE (GROUND). When the mode control line $b_n$ also goes TRUE (GROUND), all the diodes in diode gate decoder $DCN_1$ are forward biased, causing the voltage on column line $CN_1$ to go to a voltage one diode drop below GROUND. This causes diode $D_2$, which is connected between column line $CN_1$ and node $P_{1.1.p}$, to become forward biased. Due to the voltage drop across the forward biased diode $D_2$, the voltage on node $P_{1.1.p}$ will go to GROUND. If previously a field in the p direction was written in pixel $P_{1.1}$, that charge is removed from the capacitor C when node $P_{1.1.p}$ goes to GROUND.

The selection of row 1 is performed with TRUE (V+) on each of address lines $a_1$, $a_2/\ldots a_9/$. When the mode control line $a_n$ also goes TRUE (V+), all the diodes in diode gate decoder $DRN_1$ are forward biased, causing the voltage on $RN_1$ to go to a voltage one diode drop above V+. This causes diode $D_3$, which is connected between row line $RN_1$ and node $P_{1.1.n}$ to become forward biased. Due to the voltage drop across $D_3$, the voltage on node $P_{1.1.n}$ goes to V+.

The voltage differential between nodes $P_{1.1.n}$ and $P_{1.1.p}$ will charge the capacitor C in the n direction, as shown in FIG. 6A. When the mode control line $a_n$ returns to FALSE (V−), row line $RN_1$ will go to about V−, thereby backbiasing diode $D_3$. Similarly, when mode control line $b_n$ returns to FALSE (V++), column line $CN_1$ goes to about V++, thereby backbiasing diode $D_2$. At this time all of the diodes $D_1$, $D_2$, $D_3$ and $D_4$ coupled to the capacitor C in pixel $P_{1.1}$ are backbiased and the charge on the capacitor C will be retained, causing an electrical field in the n direction, as shown in FIG. 6A.

Each of the pixels in the M by N matrix of display circuit 13 can be selected by the address of its column position and address of its row position in the matrix by means of the A-address lines $a_1 \ldots a_9$ and $a_1/ \ldots a_9/$ and B-address lines $b_1 \ldots b_9$ and $b_1/ \ldots b_9/$ controlled by the mode control lines $a_p$, $a_n$, $b_p$ and $b_n$. In this manner, because of the nature of the twisted nematic liquid crystal material, all of the pixels forming the desired characters in the display circuit 13 can be alternately turned on in sequence first by electrical fields in the direction of one of the p and n fields and then by electrical fields in the direction of the other one of the p and n fields.

Figure 7:
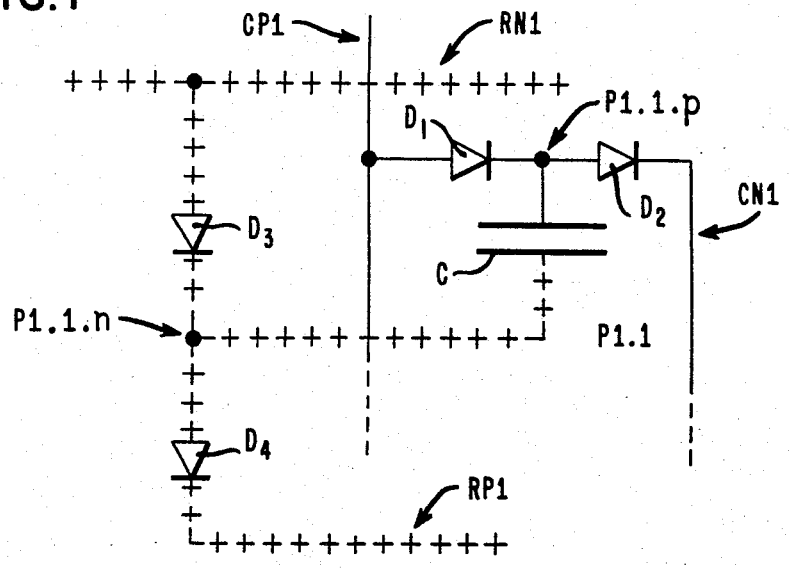
FIG. 7 is a schematic diagram of the circuit of picture element Pl.1 of FIG. 6A, with those circuit components located on one plate of the picture element shown interconnected by pluses and those circuit elements located on the other plate of the picture element shown interconnected by straight lines.

FIG. 7 is a schematic diagram of the structure of the circuit of, for example, pixel $P_{1.1}$ with the circuit components $D_3$ and $D_4$ located on one plate of the internal capacitance C of the pixel shown interconnected by pluses and the circuit components $D_1$ and $D_2$ located on the other plate of the internal capacitance C of the pixel shown interconnected by straight lines. As mentioned before, the twisted nematic liquid crystal material (not shown) is interposed between the plates of the internal capacitance C of the pixel. This circuit structure shows that on each of the two plates of the twisted nematic liquid crystal display pixel $P_{1.1}$ there are no cross-overs in the interconnections of pixel $P_{1.1}$ and the other pixels in the display circuit 13 to the four groups of diode decoders $DCP_1$–$DCP_n$, $DRP_1$–$DRP_m$, $DCN_1$–$DCN_n$ and $DRN_1$–$DRN_m$. As a result of this feature, the present invention contemplates using a micro-electronics process for manufacturing all of the diodes $D_1$–$D_4$ of each pixel in the matrix of pixels, as well as all of the diodes in the four groups of diode gate decoders $DCP_1$–$DCP_n$, $DRP_1$–$DRP_m$, $DCN_1$–$DCN_n$ and $DRN_1$–$DRN_m$ on two glass plates.

The dielectric constant of the twisted nematic liquid crystal material is dependent on the state of the material. The capacitance of the pixel capacitor C increases as the liquid crystal material reacts to the electric field. The increase in the the voltage, and consequently the electrical field. This non-linear effect can be compensated in either of two ways. First, the capacitor C can be charged to a sufficient level of electrical charge such that, after the liquid crystal material has reacted to that electric field, the remaining electric field is still high enough to retain the liquid crystal material in its turned on condition. This type of operation requires higher voltages, as well as higher diode breakdown voltage characteristics, than are required with the following preferred type of operation.

The preferred type of operation is to charge the capacitor C to a sufficient degree that the twisted nematic liquid crystal material reacts to the electric field. Subsequently, the capacitor C is successively charged a multiplicity of times in the direction of one of the p and n electric fields, before the electric field across the pixel is reversed, so as to have the pixel display a gray scale value dependent upon the number of times the pixel is charged. This preferred type of operation reduces the requirements for voltage, as well as the requirements for the breakdown voltage characteristics of the diodes. Additionally, with a suitable twisted nematic liquid crystal material, or other suitable field effect material, that reacts proportionally to an electrical field, a gray scale effect can be obtained by charging the capacitor C a smaller number of times is required to turn the pixel completely on. In this manner, different gray scale values can achieve the contrasts required of a television display in conformance with the teachings of this invention.

FIGS. 8A–8E basically illustrate the voltages selectively applied to the selected pixel $P_{1.1}$ during an initial condition, during a first mode of operation to enable the pixel to charge in the direction of the p-field and then retain that p-field charge, and during a second mode of operation to enable the pixel $P_{1.1}$ to charge in the direction of the n-field and then retain that n-field charge.

The invention thus provides a system and method for utilizing A-address and A-mode control inputs and B-address and B-mode control inputs developed in a control circuit (FIG. 1) to selectively cause the diode switching of voltages to an associated capacitor memory in each selected pixel position in a field effect liquid crystal matrix display (FIGS. 6A, 6B and 6C).

While the salient features of the invention have been illustrated and described, it should be readily apparent to those skilled in the art that many changes and modifications can be made in the system and method of the invention presented without departing from the spirit and true scope of the invention. Accordingly, the present invention should be considered as encompassing all such changes and modifications of the invention that fall within the broad scope of the invention as defined by the appended claims.

What is claimed is:

1. A display system comprising:

a matrix of display means, each of said display means including a field effect picture element having first and second inputs and a diode array selectively coupled to said first and second inputs;

means for selectively generating first and second address signals and a plurality of mode control signals during first and second modes of operation; and diode decoding means selectively coupled to said matrix of display means and being responsive to said first and second address signals and to said plurality of mode control signals from said generating means for selectively enabling predetermined ones of said diode arrays to turn on associated ones of said picture elements in a first direction during said first mode of operation and in a second direction during said second mode of operation;

each of said field effect picture elements having first and second equivalent capacitor plates being connected, respectively, to the associated said first and second inputs;

said display system also including first and second substrates; and each said diode array including first and second diodes coupled to the associated said first input and said diode decoding means and also including third and fourth diodes coupled to the associated said second input and said diode decoding means;

said first equivalent capacitor plates and said first and second diodes of each of said display means being located on said first substrate, and said second equivalent capacitor plate and the third and fourth diodes of each said display means being located on said second substrate so as to eliminate crossovers among said first and second inputs and diode array; and said diode decoding means including first, second, third, and fourth pluralities of diode decoders coupled to said display means, with said first and third pluralities of diode decoders being located on said first substrate and with said second and fourth pluralities of diode decoders being located on said second substrate.

2. A display system comprising:

a matrix of display means, each of said display means including a field effect picture element having first and second inputs and a diode array selectively coupled to said first and second inputs;

means for selectively generating first and second address signals and a plurality of mode control signals during first and second modes of operation; and a diode decoding means selectively coupled to said matrix of display mejans and being responsive to said first and second address signals and to said plurality of mode control signals from said generating means for selectively enabling predetermined ones of said diode arrays to turn on associated ones of said picture elements in a first direction during said first mode of operation and in a second direction during said second mode of operation;

said matrix of display means being comprised of a plurality of columns and a plurality of rows of display means and said diode decoding means comprising:

a first plurality of diode decoders respectively coupled to said plurality of columns and being adapted to receive said first address signals and a first mode control signal, each of said diode decoders in said first plurality of diode decoders being operative to supply a first voltage for its associated column when its column address is contained in said first address signals in a first mode of operation;

a second plurality of diode decoders respectively coupled to said plurality of rows and being adapted to receive said second address signals and second mode control signal; each of said diode decoders in said second plurality of diode decoders being operative to supply a second voltage for its associated row when its row address is contained in said second address signals in said first mode of operation;

a third plurality of diode decoders respectively coupled to said plurality of columns and being adapted to receive said second address signals and a third mode control signal, each of said diode decoders in said third plurality of diode decoders being operative io supply a third voltage for its associated column when its column address is contained in said second address signals in a second mode of operation; and a fourth plurality of diode decoders respectively coupled to said plurality of rows and being adapted to receive said first address signals and a fourth mode control signal, each of said diode decoders in said fourth plurality of diode decoders being operative to supply a fourth voltage for its associated row when its row address is contained in said first address signals in said second mode of operation;

said diode array located at the addressed column and row of said matrix either being enabled by the first and second voltages to electrically charge the associated said picture element in a first direction to produce a first electrical field across said picture element to turn said picture element on or being enabled by the third and fourth voltages to electrically charge the associated said picture element in a second direction to produce a second field across said picture element to turn said picture element on, said electrical field being retained across said picture element by the associated said diode array when the first and second address signals change to a different column or row in said matrix.

3. The display system of claim 1 wherein:

each of said field effect picture elements that is enabled by an associated one of said diode arrays is selectively turned on by being electrically charged in a first direction through its associated said diode array during said first mode of operation and in a second direction through its associated said diode array during said second mode of operation, and each of said field effect picture elements comprises a liquid crystal material having a proportional relationship between the electrical charge across said picture element and the resultant optical contrast of said picture element.

4. The display system of claim 1 wherein:

each of said field effect picture elements is comprised of a field effect material having optical properties such as to provide a contrast under the influence of an electrical field.

5. The display system of claim 1 wherein:

each of said field effect picture elements comprises a twisted nematic liquid crystal material.

6. The display system of claim 1 wherein said generating means comprises:

a microcomputer for selectively generating column and row addresses and a mode signal; and means responsive to the column and row addresses and the mode signal for selectively developing the first and second address signals and the plurality of mode control signals.

7. A display system comprising:

a matrix of display means, each of said display means including a field effect picture element having first and second inputs and a diode array selectively coupled to said first and second inputs;

means for selectively generating first and second address signals and a plurality of mode control signals during frist and second modes of operation; and diode decoding means selectively coupled to said matrix of display means and being responsive to said first and second address signals and to said plurality of mode control signals from said generating means for selectively enabling predetermined ones of said diode arrays to turn on associated ones of said picture elements in a first direction during said first mode of operation and in a second direction during said second mode of operation;

said diode array comprising;

first and second diodes coupled between said first input and said diode decoding means; and third and fourth diodes coupled between said second input and said diode decoding means;

said matrix of display means comprising a plurality of columns and a plurality of rows of display means and said diode decoding means comprising;

a first plurality of diode decoders respectively coupled to said plurality of columns and being adapted to receive said first address signals and a first mode control signal, each of said diode decoders in said first plurality of diode decoders being operative to supply a first voltage for its associated column when its column address is contained in said first address signals in a first mode of operation;

a second plurality of diode decoders respectively coupled to said plurality of rows and being adapted to receive said second address signals and a second mode control signal, each of said diode decoders in said second plurality of diode decoders being operative to supply a second voltage for its associated row when its row address is contained in said second address signals in said first mode of operation;

a third plurality of diode decoders respectively coupled to said plurality of columns and being adapted to receive said second address signals and a third mode control signal, each of said diode decoders in said third plurality of diode decoders being operative to supply a third voltage for its associated column when its column address is contained in said second address signals in a second mode of operation; and a fourth plurality of diode decoders respectively coupled to said plurality of rows and being adapted to receive said first address signals and a fourth mode control signal, each of said diode decoders in said fourth plurality of diode decoders being operative to supply a fourth voltage for its associated row when its row address is contained in said first address signals in said second mode of operation;

said diode array located at the addressed column and row of said matrix either being enabled by the first and second voltages to electrically charge the associated said picture element in a first direction to produce a first electrical field across said picture element to turn said picture element on or being enabled by the third and fourth voltages to electrically charge the associated said picture element in a second direction to produce a second field across said picture element to turn said picture element on, said electrical field being retained across said picture element by the associated said diode array when the first and second address signals change to a different column or row in said matrix.

8. The display system of claim 7 wherein:

each of the field effect picture elements comprises a liquid crystal material having a proportional relationship between the electrical charge across said picture element and the resultant optical contrast of said picture element.

9. The display system of claim 7 wherein:

each of said field effect picture elements is comprised of a field effect material having optical properties such as to provide a contrast under the influence of an electrical field.

10. The display system of claim 7 wherein:

each of said field effect picture elements comprises a twisted nematic liquid crystal material.

11. The display system of claim 7 wherein said generating means comprises:

a microcomputer for selectively generating column and row addresses and a mode signal; and means responsive to the column and row addresses and the mode signal for selectively developing the first and second address signals and the plurality of mode control signals.

12. A display system comprising;

a matrix of display means, each of said display means including a field effect liquid crystal cell having first and second inputs and first and second groups of diodes respectively coupled to said first and second inputs;

means for generating a sequence of predetermined first and second addresses and mode control signals to sequentially address preselected one of said display means; and diode decoding means selectively coupled to said first and second groups of diodes of each of said cells, said diode decoding means being responsive to each set of predetermined first and second addresses and mode control signals or selectively enabling the associated first and second groups of diodes of an addressed display means to electrically charge its associated one of said cells in a direction determined by the states of said mode control signals;

said first group of diodes including first and second diodes coupled between said first input and said diode decoding means; and said second group of diodes including third and fourth diodes coupled between said second input and said diode decoding means;

said matrix of display means comprising a plurality of columns and a plurality of rows of display means and said diode decoding means comprising:

a first plurality of diode decoders respectively coupled to said plurality of columns and being adapted to receive said first address signals and a first mode control signal, each of said diode decoders in said first plurality of diode decoders being coupled to all of said first diodes in an associated one of said columns and being operative to supply a first voltage for its associated column when its column address is contained in said first address signals in a first mode of operation;

a second plurality of diode decoders respectively coupled to said plurality of rows and being adapted to receive said second address signals and a second mode control signal, each of said diode decoders in said second plurality of diode decoders being coupled to all of said fourth diodes in an associated one of said rows and being operative to supply a second voltage for its associated row when its row address is contained in said second address signals in said first mode of operation;

a third plurality of diode decoders respectively coupled to said plurality of columns and being adapted to receive said second address signals and a third mode control signal, each of said diode decoders in said third plurality of diode decoders being coupled to all of said second diodes in an associated one of said columns and being operative to supply a third voltage for its associated column when its column address is contained in said second address signals in a second mode of operation; and a fourth plurality of diode decoders respectively coupled to said plurality of rows and being adapted to receive said first address signals and a fourth mode control signal, each of said diode decoders in said fourth plurality of diode decoders being coupled to all of said third diodes in an associated one of said rows and being operative to supply a fourth voltage for its associated row when its row address is contained in said first address signals in said second mode of operation;

said first and second groups of diodes located at the addressed column and row of said matrix either being enabled by the first and second voltages to electrically charge the associated said field effect liquid crystal cell in a first direction to produce a first electrical field across said cell to turn said cell on or being enabled by the third and fourth voltages to electrically charge the associated said cell in a second direction to produce a second field across said cell to turn said cell on, said electrical field being retained across said cell by the associated said diode array when the first and second address signals change to a different column or row in said matrix.

13. The display system of claim 12 wherein:

each of the field effect liquid crystal cells comprises a liquid crystal material having a proportional relationship between the electrical charge across said cell and the resultant optical contrast of said cell.

14. The display system of claim 12 wherein:

each of said field effect liquid crystal cells is comprised of a field effect material having optical properties such as to provide a contrast under the influence of an electrical field.

15. The display system of claim 12 wherein:

each of said field effect liquid crystal cells comprises a twisted nematic liquid crystal material.

16. The display system of claim 12 further including interconnection means respectively associated with said first, second, third and fourth diodes of each of said matrix of display means for respectively coupling said first and second diodes in each said display means between said first input of each said cell and said diode decoding means and for respectively coupling said third and fourth diodes in each said display means between said second input of each said cell and said diode decoding means and wherein said interconnection means to said diode decoding means from said first and second diodes and from said third and fourth diodes of each of said displays means are such that none of said interconnection means crosses over any other one of said interconnections means.

17. The display system as claimed in claim 2 in which said display system also includes first and second glass substrates;

each said field effect picture element having first and second equivalent capacitor plates being connected, respectively, to the associated said first and second inputs;

each said diode array including first and second diodes coupled to the associated said first input and said diode decoding means and also including thifd and fourth diodes coupled to the associated said second input and said diode decoding means;

said first equivalent capacitor plate and said first and second diodes of each of said display means being located on said first glass substrate, and said second equivalent capacitor plate and the third and fourth diodes of each said display means being located on said second glass substrate so as to eliminate crossovers among said first and second inputs and diode array.

* * * * *

UNITED STATES PATENT AND TRADEMARK OFFICE

CERTIFICATE OF CORRECTION

PATENT NO. : 4,641,135

DATED : February 3, 1987

INVENTOR(S) : Johan O. Hilbrink

It is certified that error appears in the above—identified patent and that said Letters Patent is hereby corrected as shown below:

Column 13, line 3 delete "plates" and substitute --plate--.

Column 13, line 61 delete "io" and substitute --to--.

Column 18, line 25 delete "thifd" and substitute --third--.

Signed and Sealed this

Twelfth Day of May, 1987

*Attest:*

DONALD J. QUIGG

*Attesting Officer*

*Commissioner of Patents and Trademarks*